United States Patent [19]

Salerni et al.

[11] Patent Number: 4,708,200

[45] **Date of Patent: * Nov. 24, 1987**

[54] APPARATUS FOR MAINTAINING CLEAN FLUID IN A CHAMBER IN A SUBTERRANEAN WELL TOOL

[75] Inventors: John V. Salerni, Kingwood; Joseph F. Donovan, Spring, both of Tex.

[73] Assignee: Baker Oil Tools, Inc., Orange, Calif.

[ * ] Notice: The portion of the term of this patent subsequent to May 26, 2004 has been disclaimed.

[21] Appl. No.: 868,653

[22] Filed: May 29, 1986

Related U.S. Application Data

[63] Continuation of Ser. No. 648,587, Sep. 10, 1984, Pat. No. 4,667,735.

[51] Int. Cl.[4] ..... E21B 43/117

[52] U.S. Cl. ..... 166/55.1; 175/4.52; 175/4.54

[58] Field of Search ..... 166/55.1, 297, 374, 166/381, 242, 72, 184, 185, 131, 151, 316, 319; 175/4.52, 4.54

[56] References Cited

U.S. PATENT DOCUMENTS

| | | | |
|---|---|---|---|
| 2,096,904 | 10/1937 | Layne et al. | 166/51 |
| 2,760,408 | 8/1956 | Taylor | 175/4.54 |
| 3,189,094 | 6/1965 | Hyde | 175/4.52 |
| 3,726,343 | 4/1973 | Davis, Jr. | 166/51 |
| 4,484,632 | 11/1984 | Vann | 166/297 |
| 4,498,541 | 2/1985 | Brieger et al. | 175/4.52 |
| 4,509,604 | 4/1985 | Upchurch | 175/4.52 |
| 4,531,590 | 7/1985 | Peterson | 175/4.52 |
| 4,564,076 | 1/1986 | Vann et al. | 175/4.52 |

*Primary Examiner*—James A. Leppink
*Assistant Examiner*—Hoang C. Dang
*Attorney, Agent, or Firm*—Norvell & Associates

[57] ABSTRACT

A fluid pressure activated firing head for a perforating gun disposed in a subterranean well by a packer is provided with a column of clean fluid overlying and filling the bore of the firing head but communicating with the casing annulus above the set packer. An annular fluid passage extends from the top of the clean fluid column through the set packer and ending in an inverted U-shaped annular passage. A pressure transmitting seal is mounted in the downwardly extending leg of the annular fluid passage to permit the entire fluid passage to be filled with clean fluid of a lighter density than the casing annulus fluids, thus insuring that casing annulus fluid can never enter the interior of the pressure activated firing head.

5 Claims, 7 Drawing Figures

APPARATUS FOR MAINTAINING CLEAN FLUID IN A CHAMBER IN A SUBTERRANEAN WELL TOOL

RELATIONSHIP TO CO-PENDING APPLICATION

This application constitutes a continuation of U.S. application Ser. No. 648,587, filed Sept. 10, 1984, now U.S. Pat. No. 4,667,735.

BACKGROUND OF THE INVENTION

1. Field of the Invention:

The invention relates to a fluid pressure activated perforating gun for subterranean wells and particularly to an apparatus for assuring that only clean fluid is in contact with the fluid pressure activated apparatus contained in the firing head of the perforating gun.

2. History of the Prior Art:

Perforating guns activated through the application of a fluid pressure differential between the fluid pressure contained within a firing head and the fluid pressure existing in the well annulus adjacent the firing head have been heretofore utilized in well drilling industry. See, for example, the MODEL B FIRING HEAD, Product No. 492-70 sold by BAKER SAND CONTROL DIVISION, BAKER OIL TOOLS, INC. of Houston, Tex. Normally, the perforating gun, together with its fluid pressure activated firing head, is suspended in the well from a packer. A fluid crossover device is incorporated in a depending tubing assembly connected at its upper end to the packer bore and at its lower end to the bore of the fluid pressure activated firing device. Such crossover device effects the diversion of fluid supplied at its upper end bore to the casing annulus.

The fluid pressure activated firing device is then fired by increasing the annulus pressure at the well surface and, through the operation of the crossover device in the tubing assemblage, this produces a fluid pressure increase in the bore of the fluid pressure activated firing device over the annulus pressure existing around the device, thus effecting its actuation and the discharge of the perforating gun. This arrangement has the further advantage of permitting the gun to be discharged when the fluid pressure in the annulus area adjacent the newly formed perforations is in a so-called underbalanced condition; i.e., the fluid pressure is substantially less than the anticipated formation pressure so that an immediate purging flow of formation fluid is produced through the newly formed perforations and into the casing annulus below the packer, then upwardly through the crossover device into the interior of the work string or production string connected to the packer.

Difficulty has been encountered with fluid pressure activated firing devices of the type described above due to the fact that the annulus fluid above the packer may very well be a relatively heavy fluid, such as drilling mud, containing substantial quantities of particulates. It is highly undesirable that this heavy, contaminated fluid be permitted to enter the interior of the fluid pressure activated firing device. Yet, this has been a common occurrence with prior art firing devices.

A similar problem is encountered whenever a subterranean well tool is provided with a chamber filled with a clean fluid which is subject to fluid pressure by the well fluids. For example, it is common to provide chambers filled with a clean fluid for the purpose of trapping a fluid pressure within the chamber which is proportional to the well fluid pressure.

SUMMARY OF THE INVENTION

The invention provides a fluid pressure activated firing head for a perforating gun which is connected in depending relationship to a packer by a tubing assembly. Such tubing assembly includes a fluid crossover device, by which fluid supplied to the casing annulus above the packer is directed into the bore of the fluid pressure activated firing head for effecting the discharge of the perforating gun. The crossover device is provided with axially extending fluid passages which communicate with an axially extending fluid passage extending through the entire packer and opening into the casing annulus above the packer. The opening into the casing annulus is defined by a conduit having a downwardly facing end, so that if fluid is to enter the axially extending conduit through the packer, it must move upwardly through a downwardly extending leg of the conduit. A wiper-type seal is provided at the downwardly facing end of the conduit which permits the entire fluid pressure passage to the interior of the firing head to be filled at the well surface with a clean, relatively light weight fluid, such as water.

When the aforedescribed apparatus is inserted into the well, there will be some thermal expansion of the clean fluid contained in the aforedescribed passage and the seal means permits sufficient leakage of such fluid to accommodate the thermal expansion of the clean fluid. On the other hand, the relatively heavy particulate containing well fluid normally found in the casing annulus, cannot enter the aforedescribed axially extending fluid passage to the hydraulically actuated firing head due to the difference in specific gravity of the clean fluid and the well fluid. The clean fluid, in effect, floats on the heavier well fluid and prevents the entry of well fluid past the seal means and upwardly through the end of the axially extending fluid passage.

After setting of the packer, an activating fluid pressure applied to the well fluid contained in the casing annulus above the packer will result in the application of a corresponding pressure to the clean fluid contained in the axially extending passage and applied by such clean fluid to the hydraulically activated firing mechanism for the perforating gun. It is thereby assured that the perforating gun is discharged solely by fluid pressure applied by a clean fluid and the problems heretofore encountered with contaminates entering into the relatively small clearances normally found in the piston-cylinder elements of the hydraulically activated firing head are eliminated.

In its broadest aspects therefore, this invention contemplates an apparatus for maintaining a clean fluid within a chamber of a subterranean well tool which is subject to fluid pressure by well fluids external to the tool.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
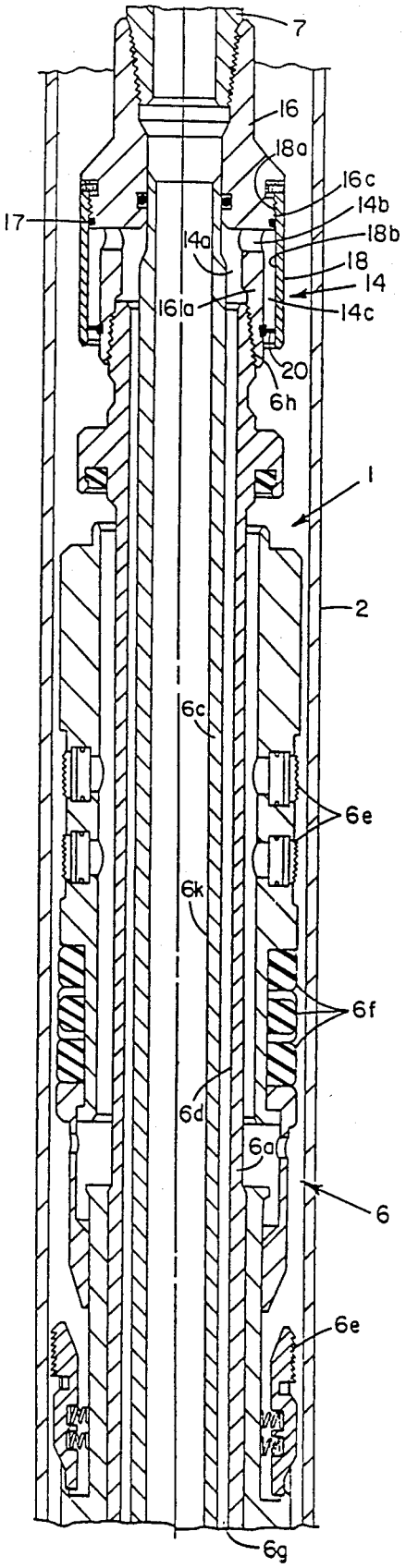
FIGS. 1A, 1B, and 1C collectively constitute a vertical sectional view of a packer and perforating gun with the elements thereof disposed in a run-in position in a well.
Figure 1B:
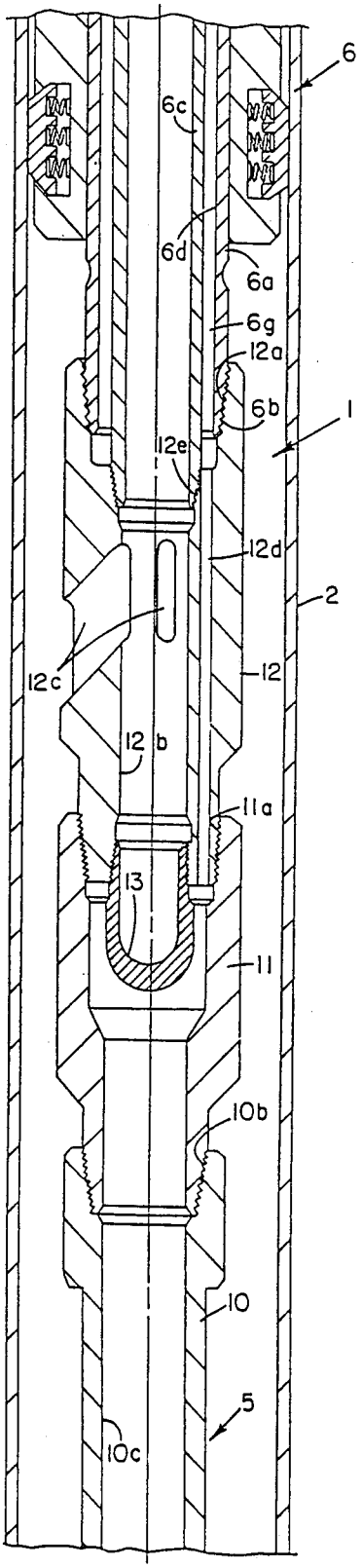
Figure 1C:
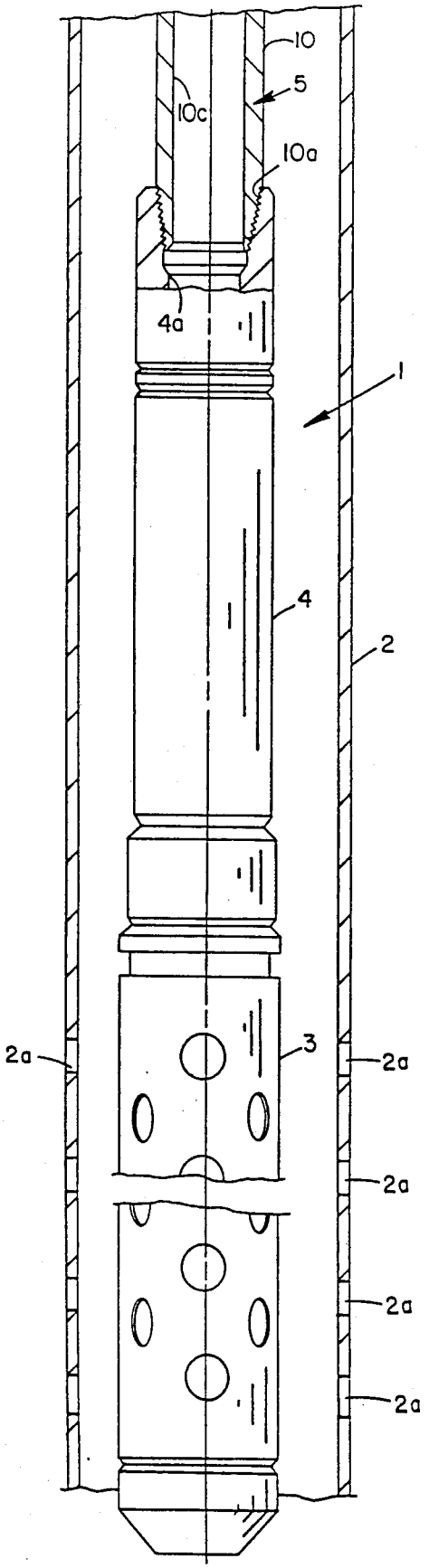

Referring to FIGS. 1A through 1C, there is schematically shown a perforating apparatus 1 embodying this invention in a run-in position with respect to the casing 2 of a subterranean well. From the bottom upward, the apparatus comprises a conventional perforating gun 3 which in turn is suspended from a conventional hydraulically actuated firing head 4. Firing head 4 is in turn suspended from a tubing assembly 5. Tubing assembly 5 is suspended from the lower end of a conventional packer 6 and the packer is run into the well on a tubing string 7, which can be either a work string or a production string.

Figure 2A:
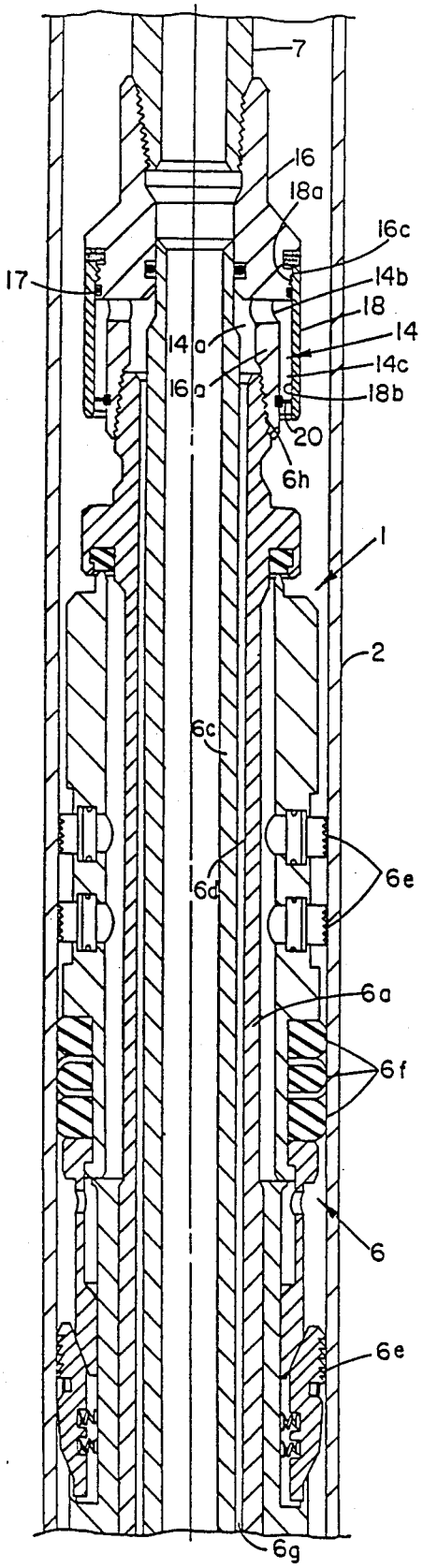
FIGS. 2A, 2B, and 2C respectively correspond to FIGS. 1A, 1B, and 1C with the packer set and the gun discharged.
Figure 2B:
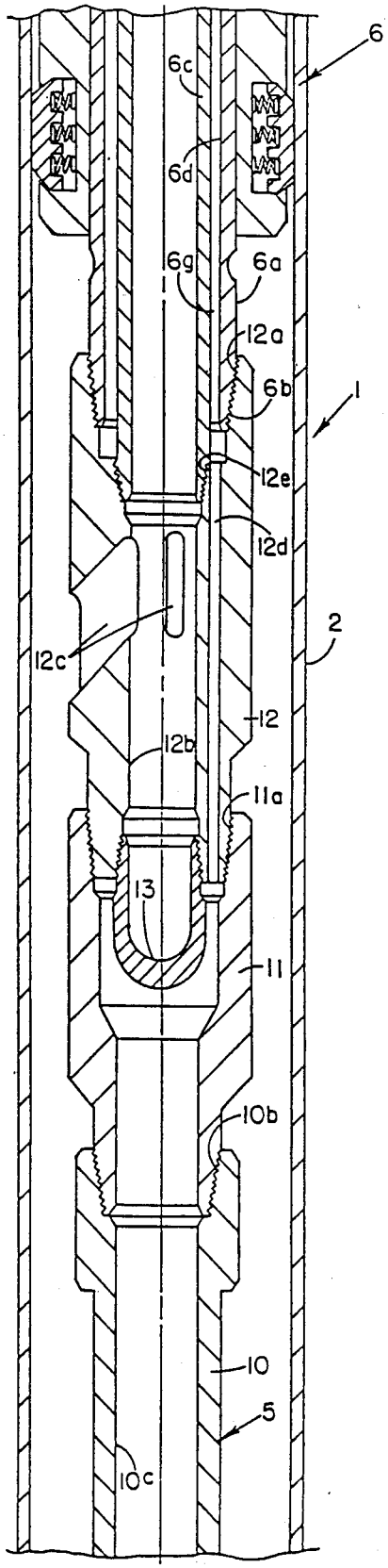
Figure 2C:
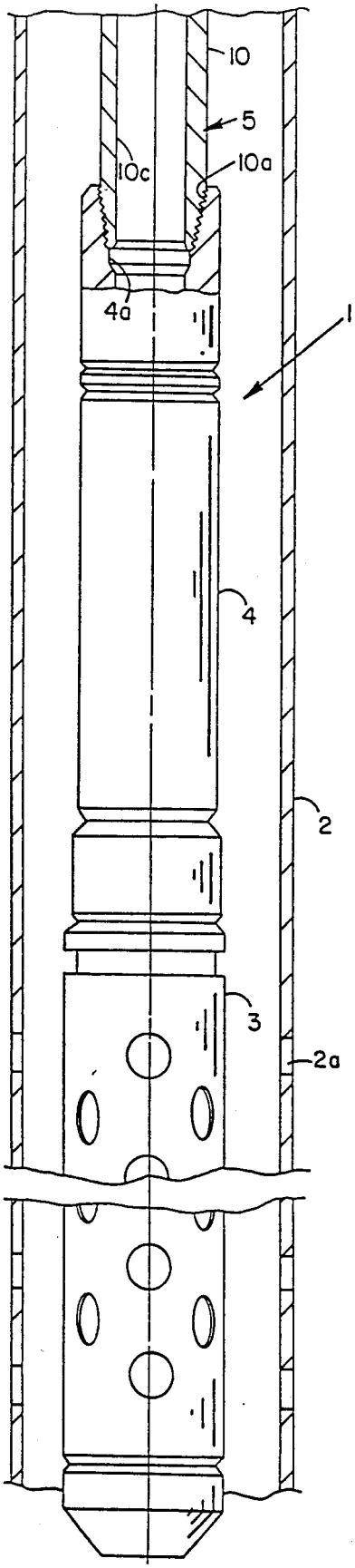

Referring to FIGS. 2A and 2B, it will be noted that the tubing assembly 5 comprises a lower spaceout sleeve 10 having external threads 10*a* for effecting a threaded and sealable connection with the upper end of the firing head 4. The upper end of the spaceout sleeve 10 is provided with internal threads 10*b* which are engaged with external threads provided on the lower portion of an enlargement sub 11 which is secured to the bottom of a crossover element 12 by threads 11*a*. Crossover element 12 is in turn secured by internal threads 12*a* to the external threads 6*b* provided on the lower end of the tubular main body portion 6*a* of the packer 6.

The bore 12*b* of the crossover element 12 is closed by a plug 13 but communicates with radially directed, peripherally spaced fluid passages 12*c* so that fluid passing downwardly into the bore 12*b* of the crossover element 12 is diverted outwardly to the casing annulus at a position below the packer 6.

Figure 3:
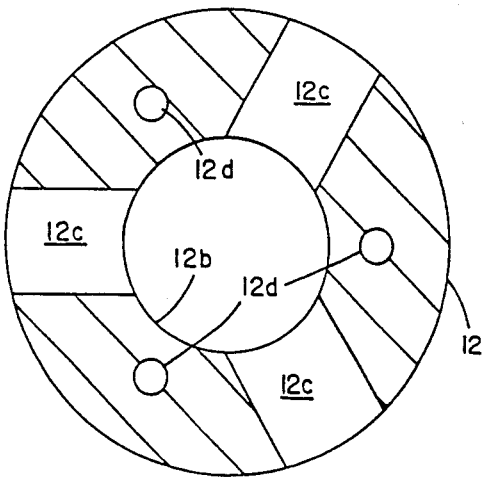
FIG. 3 is a sectional view illustrating the fluid passages through the cross-over portion of the apparatus.

A plurality of peripherally spaced, axially extending fluid passages 12*d* (FIG. 3) are, however, separately provided in the corssover element 12. The axially extending passages 12*d* communicate with an annular, axially extending fluid passage 6*g* defined between the internal bore of the body 6*a* of packer 6 and the exterior of a sleeve 6*c* which traverses the entire internal bore 6*d* of packer body 6*a*. Internal sleeve 6*c* is provided with external threads at its bottom end which cooperate with internal threads 12*e* provided in the crossover element 12 at a position below the threads 12*a*.

The annular fluid passage 6*g* extends entirely through the packer 6 and thus provides a passageway for fluid when the packer is set as illustrated in FIGS. 2A and 2B. In accordance with this invention, the axially extending annular fluid passage 6*g* terminates at its upper end in a generally U-shaped cross-section, annular fluid passage 14 having a short upwardly extending leg 14*a*, a plurality of peripherally spaced radial ports 14*b*, and a downwardly extending annular passage 14*c*. The annular U-shaped fluid passage 14 is defined by a pair of sleeve elements 16 and 18 which are secured to the top end of the body of the packer 6. Sleeve element 16 comprises a lower reduced-thickness portion 16*a* having internal threads 16*b* cooperating with the packer body threads 6*h*. The annular space between the reduced-thickness portion 16*a* and the exterior surface of internal sleeve 6*c* defines the upwardly extending leg 14*a* of the U-shaped annular fluid passage 14. The radially extending ports 14*b* are formed in the top end of the reduced-thickness portion 16*a* of the sleeve element 16. The upper portion of the sleeve element 16 is of increased thickness and defines external threads 16*c* which cooperate with internal threads 18*a* provided in the top end of sleeve 18. O-ring seal 17 effects the sealing of the threads 18*a*. The internal bore 18*b* of the sleeve 18 is disposed in radially spaced relationship to the exterior of the reduced-thickness portions 16*a* of the sleeve element 16 and defines the downwardly extending leg 14*c* of the U-shaped annular fluid passage 14.

Adjacent the downwardly facing opening of the downwardly extending leg 14*c*, an annular wiping seal 20 is provided. This seal comprises a flexible membrane which is effective to retain fluid within the annular U-shaped fluid passage 14, but will also permit a controlled leakage of such fluid when expansion of the fluid occurs. Similarly, the wiper seal 20 is responsive to any fluid pressure existing in the casing annulus above the packer 6 to transmit such pressure to the fluid contained in the U-shaped annular passage 14.

In operation, the assemblage is run-in with the components thereof disposed in the positions illustrated in FIGS. 1A, 1B, and 1C.

Prior to insertion of the apparatus 1 into the well, the entire fluid conduit extending from the wiper seal 20, through the annular U-shaped fluid passage 14, the annular passage 6*g* extending through the packer body 6*a*, the axially extending fluid passages 12*d* in the crossover element 12, and the bore 4*a* of the fluid pressure activated firing device 4 are filled with a light density clean fluid, such as water. Any fluid may be employed that has a density substantially lighter than the well fluids contained in the well annulus above the set packer 6.

As shown, the packer 6 is then set by conventional method so that the slip elements 6*e* and the elastomeric sealing elements 6*f* of the packer 6 assume positions of engagement with the wall of casing 2 in conventional fashion, as illustrated in FIG. 2A.

It should be understood that the packer 6 may be of the mechanical type, as illustrated, set by manipulation of the work string, or the like. Also, minor modifications to the crossover assembly comprising 16, 6*c*, 12, 13, and 11 will allow use of a conventional pressure activated packer, or any packer set in a well prior to the insertion of the crossover assembly.

After setting of the packer 6, the fluid pressure within the bore of the packer 6*k* is substantially reduced and concurrently the fluid pressure in the casing annulus above the packer 6 is increased to a substantial level above that existing within the bore of the packer 6*k*. This increased fluid pressure is transmitted to the interior of the hydraulically activated firing head 4 through the pressure-transmitting wiper seal 20, through the U-shaped annular fluid passage 14, then downwardly through the entire packer body through the annular passage 6*g*, thence through the plurality of peripherally spaced, axially extending passages 12*d* provided in the crossover element 12, thence through the bore 10*c* of the spaceout sub 10 into the bore 4*a* of the firing head 4. When this fluid pressure reaches a predetermined differential with that existing in the casing annulus below the set packer 6, the firing head 4 is activated in conventional manner to drive a hammer (not shown) in contact with a detonatable charge (not shown) and achieve the firing of the perforating gun 3, producing perforations 2*a*.

Those skilled in the art will recognize that the aforedescribed apparatus will effectively maintain a column of clean fluid above and in the interior of the fluid pressure activated firing head 4. Thus, the reliable operation of the firing head is insured and, of equal importance, the reusability of the firing head is preserved due to the fact that contaminating fluids, such as found in the casing annulus, are not permitted to enter into the clean column of fluid overlying and filling the bore of the fluid pressure activated firing head.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A subterranean well tool suspendable in a well bore containing fluid on a well conduit defining an annulus between the exterior of the conduit and the well bore; said well tool defining a vertically extending internal chamber filled with a clean fluid having a specific gravity less than the well fluids contained in said annulus; means for subjecting said clean fluid to the fluid pressure of said annulus fluids comprising: annular conduit means communicating with the top portions of said vertically extending chamber and extending upwardly and defining an inverted U-shaped annular passage; said inverted U-shaped annular passage having a downwardly directed annular passage communicating with said annulus; and pressure transmitting sealing means fixedly secured in the lower end of said downwardly directed passage and operative in said fixed position to transmit annulus fluid pressure to said clean fluid, whereby said vertically extending chamber, said annular conduit means, and said inverted U-shaped annular passage may be filled with said clean fluid at the top of the well and said clean fluid in said chamber is uncontaminated by annulus fluids during insertion and residence of the tool in the well.

2. The apparatus of claim 1 wherein said pressure transmitting sealing means comprise an annular elastomeric ring having one peripheral surface embedded in one wall of said downwardly directed annular passage and another peripheral surface engaging the other wall of said downwardly directed annular passage in wiping relation.

3. A subterranean well tool comprising a packer connected to the bottom of a tubing string and settable in a well bore containing fluids, said tubing string defining an annulus between the exterior of the tubing string and the well bore; said packer having a central bore of greater diameter than the tubing string bore; a hollow housing suspended from said packer, said housing defining a vertically extending chamber filled with a clean fluid having a specific gravity less than the well fluid contained in said annulus; means defining an annular conduit extending through said packer central bore and communicating with the top portions of said vertically extending chamber; means above said packer defining an inverted U-shaped annular passage having one annular leg communicating at one end with said annular conduit and the other annular leg communicating with said annulus; and pressure transmitting sealing means fixedly secured in the lower end of said other annular leg and operative in said fixed position to transmit annulus fluid pressure to said clean fluid, whereby said chamber, said annular conduit means, and said inverted U-shaped annular passage may be filled with said clean fluid at the top of the well and said clean fluid in said chamber remains uncontaminated by annulus fluids during insertion and residence of the tool in the well.

4. The apparatus of claim 3 wherein said pressure transmitting sealing means comprise an annular elastomeric ring having one peripheral surface embedded in one wall of said other annular leg and another peripheral surface engaging the other wall of said other annular leg in wiping relation.

5. The apparatus of claim 3 wherein said means defining an annular conduit comprises a sleeve mounted in said packer central bore, said sleeve having an internal diameter substantially equal in diameter to the tubing string bore.

* * * * *